US006551136B2

(12) United States Patent
Johnsen et al.

(10) Patent No.: US 6,551,136 B2
(45) Date of Patent: Apr. 22, 2003

(54) CLOSED END COAXIAL CONNECTOR

(75) Inventors: David J. Johnsen, New Hope, MN (US); John H. Lystad, Bloomington, MN (US); Thomas L. Barnes, Eden Prairie, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 09/960,230

(22) Filed: Sep. 20, 2001

(65) Prior Publication Data

US 2003/0054689 A1 Mar. 20, 2003

(51) Int. Cl.[7] ..... H01R 9/05
(52) U.S. Cl. ..... 439/578
(58) Field of Search ..... 439/578, 675, 439/851

(56) References Cited

U.S. PATENT DOCUMENTS

| | | | | |
|---|---|---|---|---|
| 5,417,588 A | | 5/1995 | Olson et al. | 439/585 |
| 5,730,622 A | | 3/1998 | Olson | 439/578 |
| 6,109,963 A | * | 8/2000 | Follingstad et al. | 439/578 |
| 6,174,206 B1 | * | 1/2001 | Yentile et al. | 439/638 |

OTHER PUBLICATIONS

"Connector Products 75 Ohm BNC Connectors", ADC Telecommunications, Inc., pp. 1–12 (1998).
"Digital Signal Cross–Connect (DSX–3) Front and Rear Cross–Connect Products", ADC Telecommunications, Inc., pp. 1–71 (1996).

Exhibit A ADC Telecommunications, Inc., Coaxial Connector, 5 Photos.

Exhibit B ADC Telecommunications, Inc., Coaxial Connector, 3 Photos.

Exhibit C ADC Telecommunications, Inc., Design Drawings of the Coaxial Connector of Ex. B, 1 Sheet.

Exhibit D ADC Telecommunications, Inc., Design Drawings of catalog No. DSX4J–PX00C, 4 Sheets.

* cited by examiner

*Primary Examiner*—Gary Paumen
*Assistant Examiner*—Ann McCamey
(74) *Attorney, Agent, or Firm*—Merchant & Gould P.C.

(57) ABSTRACT

A telecommunications coaxial connector comprises a body with a first open end, an opposite second open end and an axial opening defined through the body, a cap positioned about the first open end. The cap is electrically connected with the body and includes a side wall, an open end aligned with the axial opening and a continuous ring about the open end of the cap and an integral spring member defined in the side wall. A center conductor is positioned within the axial opening such that the center conductor extends into the cap and an insulator electrically isolating the center conductor from the body. The present invention also relates to a telecommunications chassis including an enclosure with open ends and a bulkhead with coaxial telecommunications connectors, the bulkhead positioned across an open end with the coaxial telecommunications connectors within the enclosure. The present invention further relates to a method of assembling a telecommunications coaxial connector and a method of forming a cap for a telecommunications coaxial connector.

13 Claims, 11 Drawing Sheets

CLOSED END COAXIAL CONNECTOR

FIELD OF THE INVENTION

The present invention relates to coaxial connectors. More specifically, the present invention relates to a coaxial connector for slidably mating with another coaxial connector.

BACKGROUND OF THE INVENTION

In the telecommunications industry, it is known to use circuit modules in a chassis mounted in equipment racks to provide connection and cross-connection for telecommunications circuits. These modules may incorporate coaxial connectors along the one of their edges, the modules being designed for insertion into the chassis such that these connectors interface with mating coaxial connectors incorporated into the chassis.

The connectors incorporated into the chassis must be durable enough to withstand repeated insertions and removals of the module connectors, as the modules may be removed and reinserted multiple times. Manufacturing and insertion tolerances required that these chassis connectors also be capable of accepting modules which might be inserted slightly out of alignment. Also, these chassis connectors often provide some degree of engagement force against the modules connectors, such as springs or others tabs, which are capable of withstanding multiple insertion/extraction cycles. High manufacturing costs, breakage of parts and poor connections are concerns needing attention.

SUMMARY OF THE INVENTION

The present invention relates to a telecommunications coaxial connector comprising a body with a first open end, an opposite second open end and an axial opening defined through the body and a cap positioned about the first open end. The cap is electrically connected with the body and includes a side wall, an open end aligned with the axial opening, and a continuous ring about the open end of the cap and an integral spring member defined in the side wall. A center conductor is positioned within the axial opening such that the center conductor extends into the cap and an insulator electrically isolates the center conductor from the body.

The present invention also relates to a telecommunications chassis including a bulkhead with coaxial telecommunications connectors with electrically connected ends and an enclosure with open ends, the bulkhead positioned across an open end with the coaxial telecommunications connectors within the enclosure. The coaxial telecommunications connectors each having a body with a first open end, an opposite second open end and an axial opening defined through the body, and a cap positioned about the first open end. The cap is electrically connected with the body and includes a side wall, an open end aligned with the axial opening, a continuous ring about the open end of the cap and an integral spring member defined in the side wall, and a center conductor positioned within the axial opening such that the center conductor extends into the cap and an insulator electrically isolating the center conductor from the body.

The present invention further relates to a method of assembling a telecommunications coaxial connector.

The present invention further relates to a method of forming a cap for a telecommunications coaxial connector.

A variety of advantages of the invention will be set forth in part in the description that follows, and in part will be apparent from the description, or may be learned by practicing the invention. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of the specification, illustrate several aspects of the invention and together with the description, serve to explain the principles of the invention. A brief description of the drawings is as follows.

DETAILED DESCRIPTION

Figure 1:
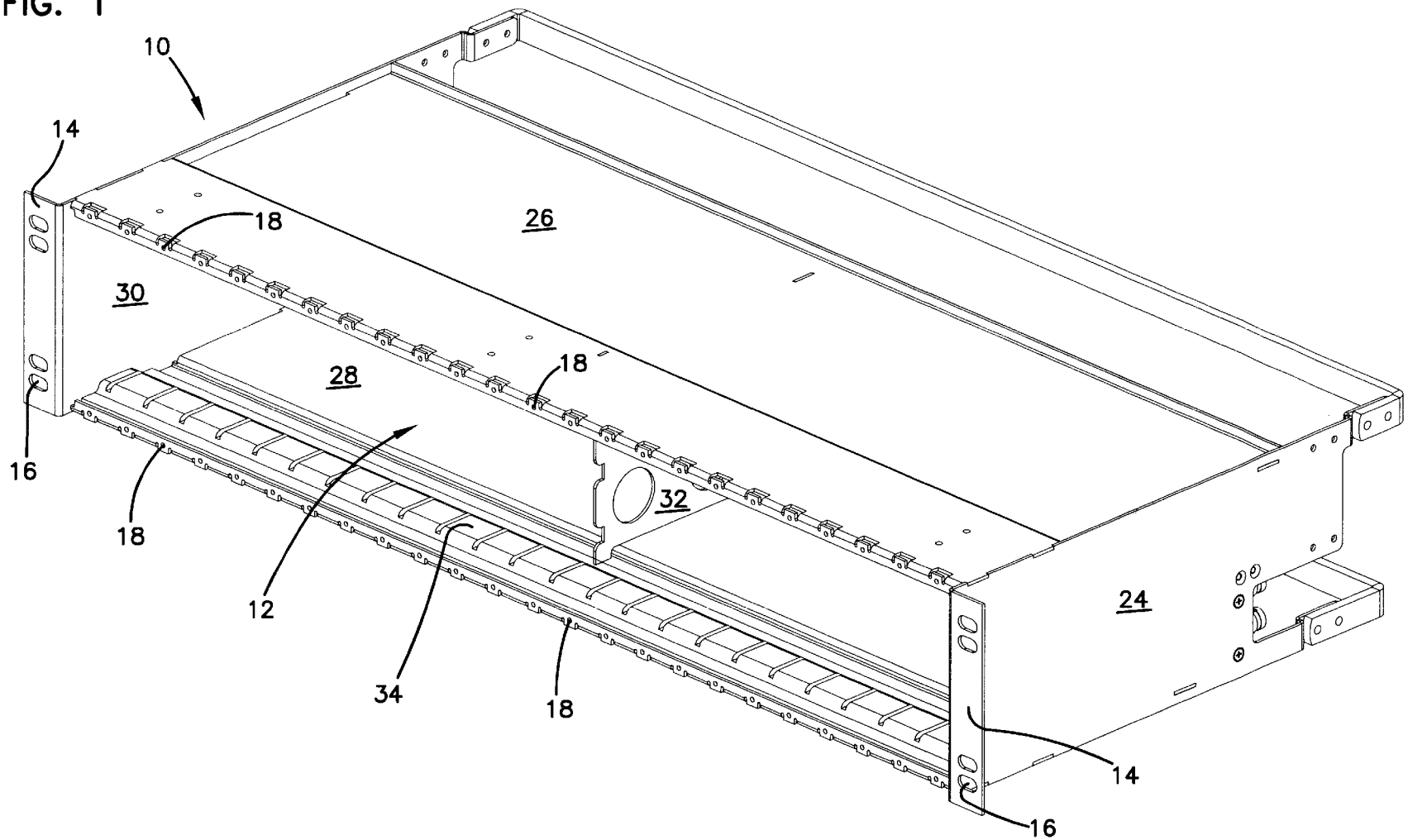
FIG. 1 is a front perspective view of a telecommunications rack mount chassis according to the present invention.
Figure 2:
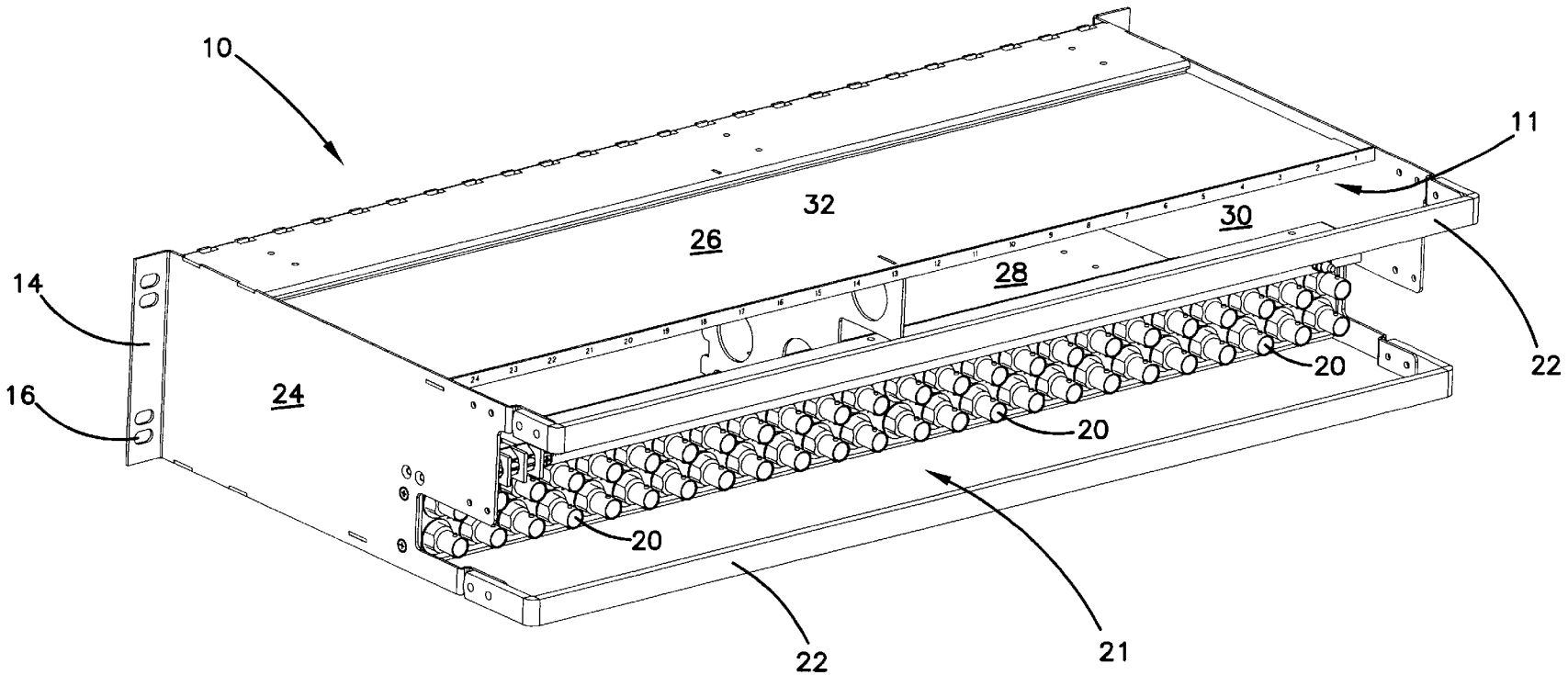
FIG. 2 is a rear perspective view of the telecommunications rack mount chassis of FIG. 1.
Figure 3:
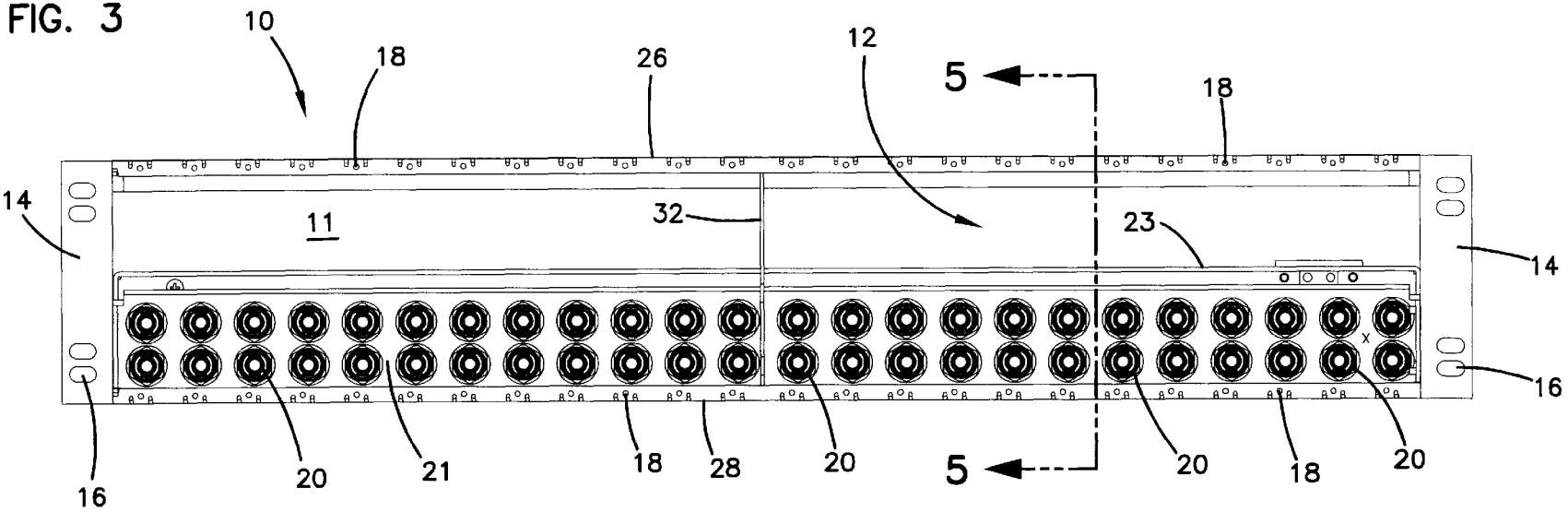
FIG. 3 is a front view of the telecommunications rack mount chassis of FIG. 1.
Figure 4:
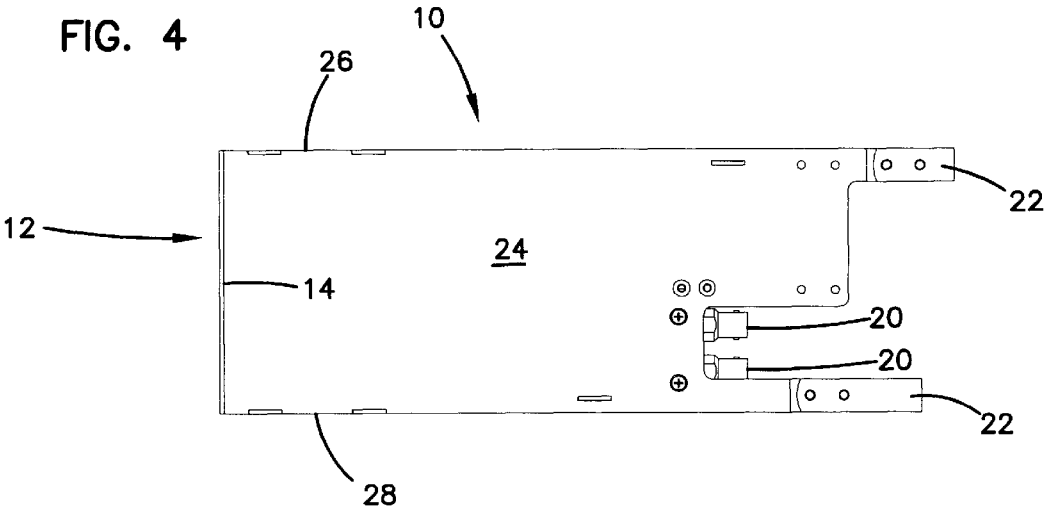
FIG. 4 is a side view of the telecommunications rack mount chassis of FIG. 1.
Figure 5:
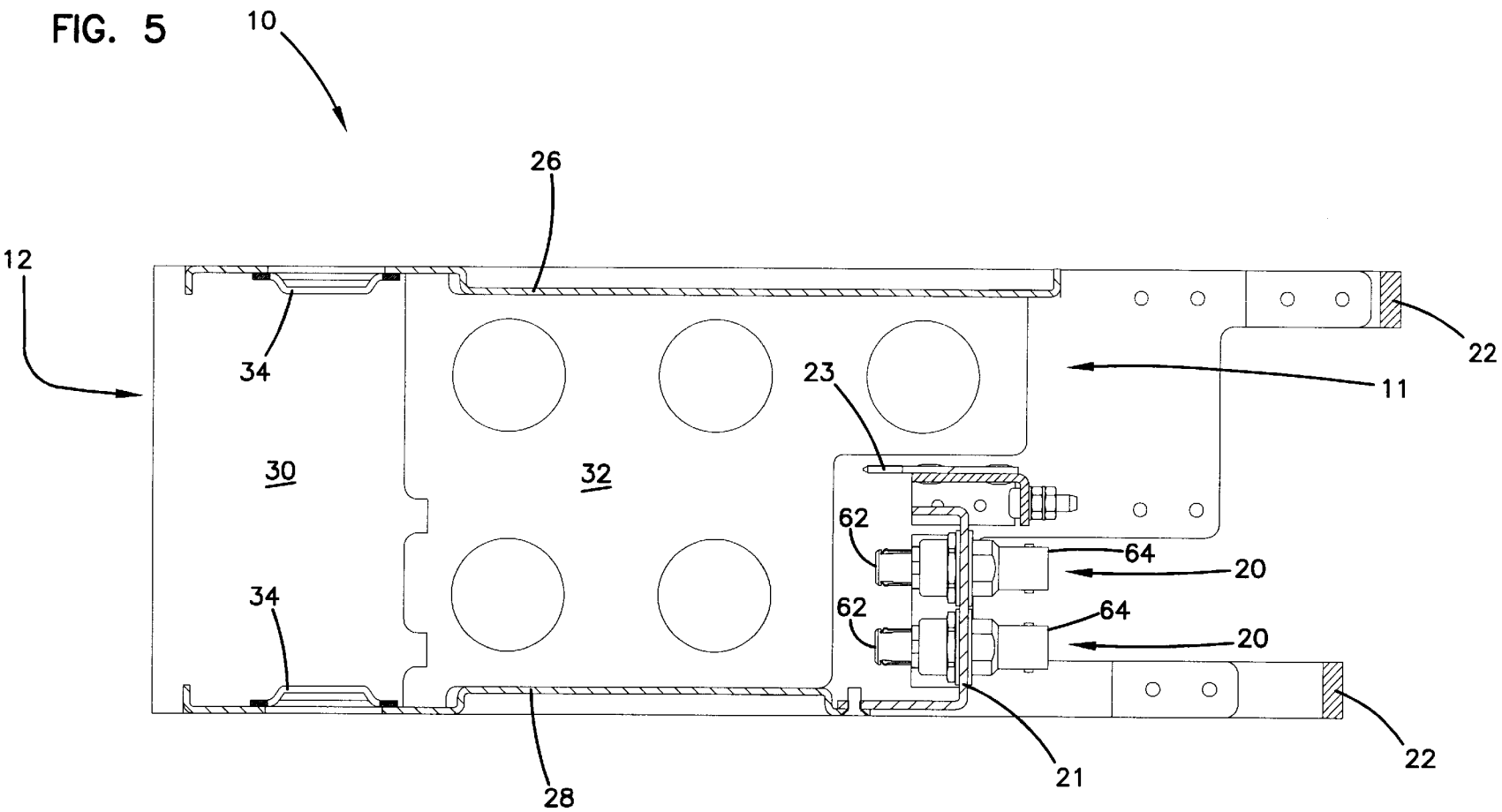
FIG. 5 is a cross-sectional view of the telecommunications rack mount chassis of FIG. 1, taken along line 5—5 in FIG. 3.

Reference will now be made in detail to exemplary aspects of the present invention that are illustrated in the accompanying drawings. Wherever possible, the same reference numbers will be used throughout the drawings to refer to the same or like parts.

In the telecommunications industry, facility installations often require switching and cross-connect equipment to be mounted in dense, rack-mounted central location. Such an installation might involve one or more equipment bays and a variety of network elements connected throughout the facility led to the proximity of the bays or racks. Chassis installed in the racks with back plane connections linked to these network elements might then be pre-wired to these network elements. When the network elements need to be utilized to provide telecommunications connectivity to a particular part of the facility, a circuit module is then installed in the appropriate slot in a chassis.

For telecommunications installations such as these, the use of coaxial cable for the network elements is common. In conjunction with the coaxial cable, coaxial connectors may be installed on the back plane of the chassis. As well, coaxial connectors might be used on the modules to connect with these back plane connectors and thus with the network elements. It is known for the back plane connectors to mate with the network elements via a coaxial connector and for the modules to have the same type of coaxial connector. For example, the back plane connectors might provide BNC connectors for linking to the network elements and also have a connector that is able to mate with BNC connectors on the rear of the modules. The use of other types of coaxial connectors, or other similar connectors, is also anticipated.

Referring now to FIGS. 1 through 5, a chassis 10 for use in a telecommunications equipment rack is shown. Chassis 10 includes a top 26, a bottom 28 and opposing sides 24 and 30, which cooperate to define an interior with a first opening 12 and a opposing second opening 11. Along first opening 12 in both top 26 and bottom 28 are defined a series of module attachment openings 18. Mounted within chassis 10 on top 26 and bottom 28 proximate first opening 12 are module guides 34. Centrally located within chassis 10, extending from top 26 to bottom 28 and approximately parallel to sides 24 and 30 is a support 32. Extending outward from sides 24 and 30 proximate first opening 12 are mounting flanges 14 with mounting holes 16 defined for mounting chassis 10 to a rack (not shown) along with additional chassis 10 or other equipment. Second opening 11 is further defined by a back plane 21 to which are mounted coaxial bulkhead connectors 20. An edge connector strip 23 provides electrical power for circuit tracing. Extending beyond back plane 21, sides 24 and 30 also provide support to cable guides 22, which provide support and protection to those network elements that are led to second opening 11.

Figure 6:
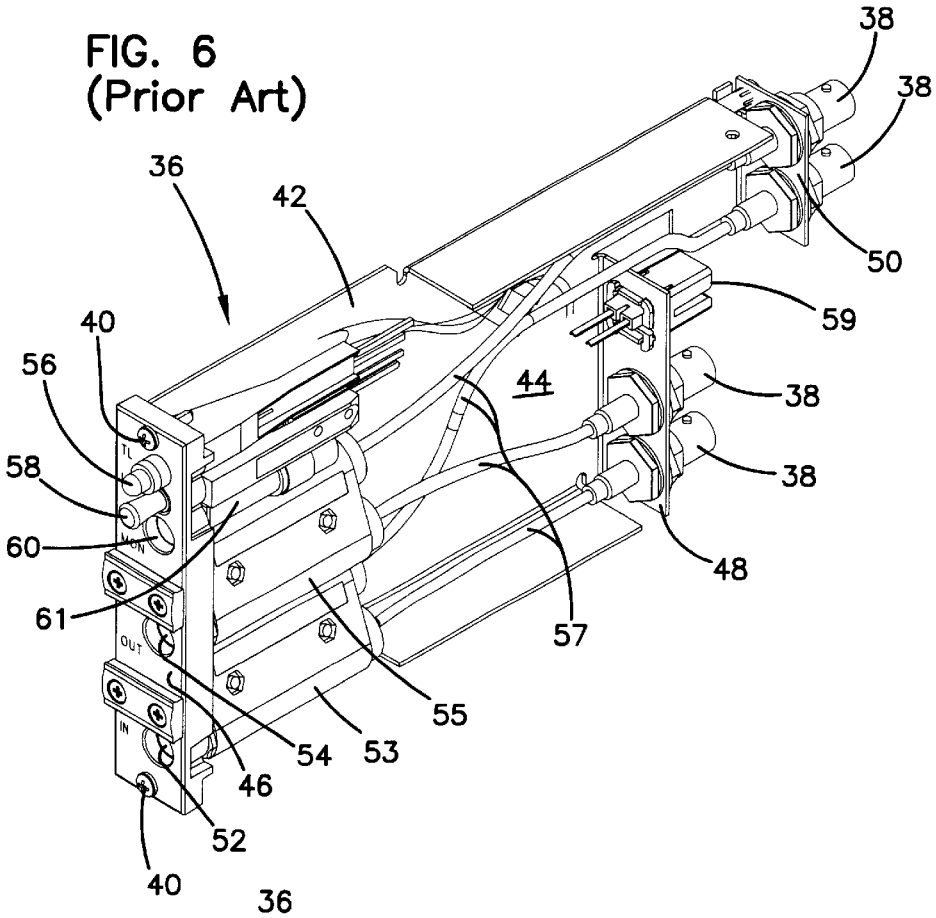
FIG. 6 (Prior Art)
FIG. 6 is a front perspective view of a prior art telecommunications circuit module for use with the telecommunications rack mount chassis of FIG. 1.
Figure 7:
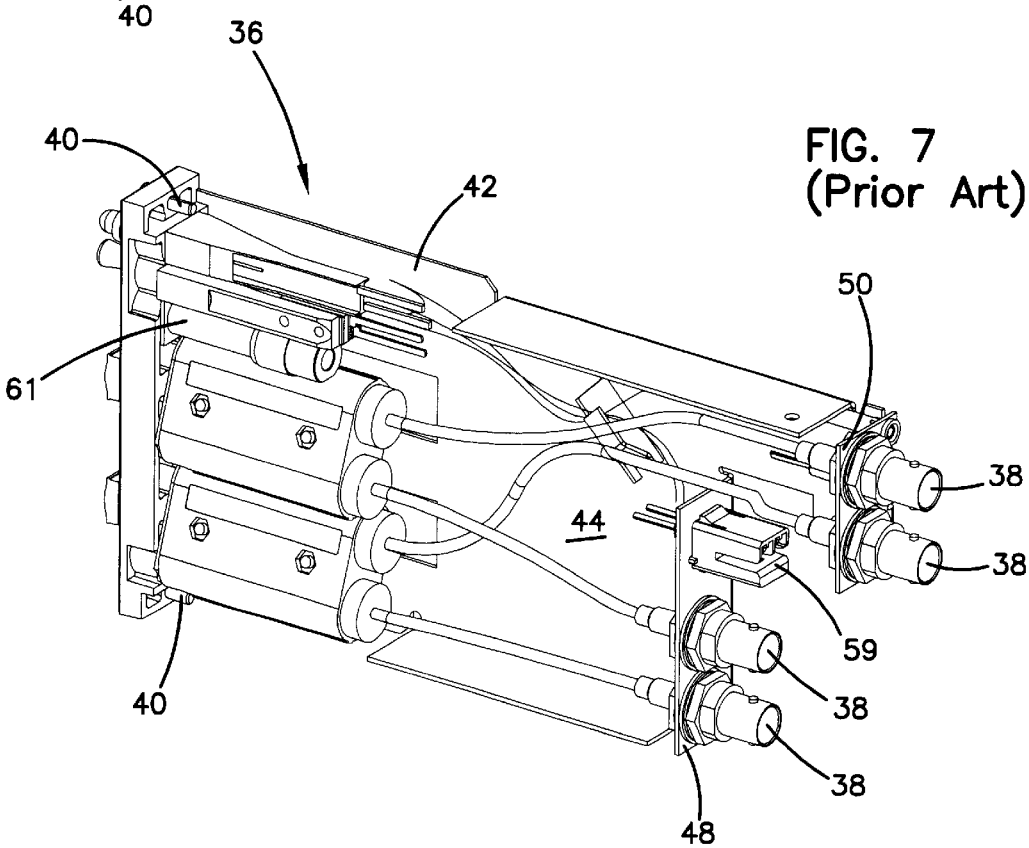
FIG. 7 (Prior Art)
FIG. 7 is a rear perspective view of the telecommunications circuit module of FIG. 6.

Referring now to FIGS. 6 and 7, a module 36 for use with a chassis 10 is shown. Module 36 includes a first pair of coaxial connectors 38 mounted to a first rear edge 48 and a second pair of coaxial connectors 38 mounted to a second rear edge 50, the two rear edges being offset from one another. Module 36 also includes a face plate 46 on which are found an IN switching port 52, an OUT switching port 54 and a monitor port 60. Switching jacks 53 and 55, monitor jack 61, and cables 57, link ports 52, 54 and 60 to connectors 38. A tracer lamp 56 and a tracer lamp switch 58 are provided for circuit tracing. Power for tracing lamp 56 is provided through a mating edge connector 59 for mating with an edge connector strip 23.

Extending through face plate 46 are two fasteners 40 which engage openings 18 on chassis 10 when module 36 is inserted into opening 12. Housing 44 connects face plate 46 to back planes 48 and 50 and includes a pair of guide tabs 42 which interface with module guides 34 to properly orient and position module 36 within chassis 10. When module 36 is inserted into chassis 10 such that tabs 42 interface with module guide 34 and fasteners 40 engage openings 18, coaxial connectors 38 are correctly positioned to slidably mate with module interface ends 62 of bulkhead connectors 20 and thus to any network elements connected to network interface ends 64 of bulkhead connectors 20.

Module 36 is an example cross-connect module commercially available from ADC Telecommunications, Inc., catalog no. DSX-4U-MBRC. It is to be appreciated that other modules can interface with chassis 10. Chassis 10 can further be configured with a variety of other arrangements to slidably receive other modules for slidably mating with coaxial bulkhead connectors 20 with the coaxial connectors of the modules.

Figure 8:
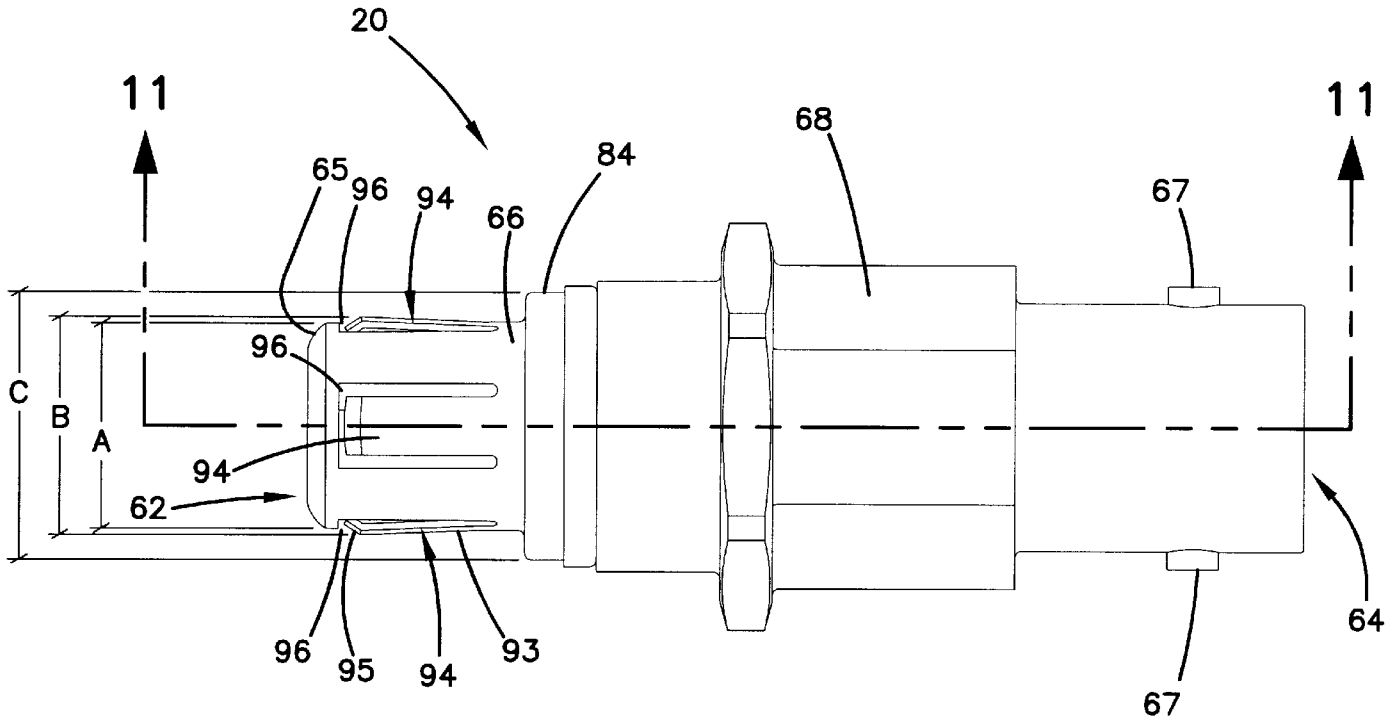
FIG. 8 is a side view of a bulkhead mount coaxial connector according to the present invention.
Figure 9:
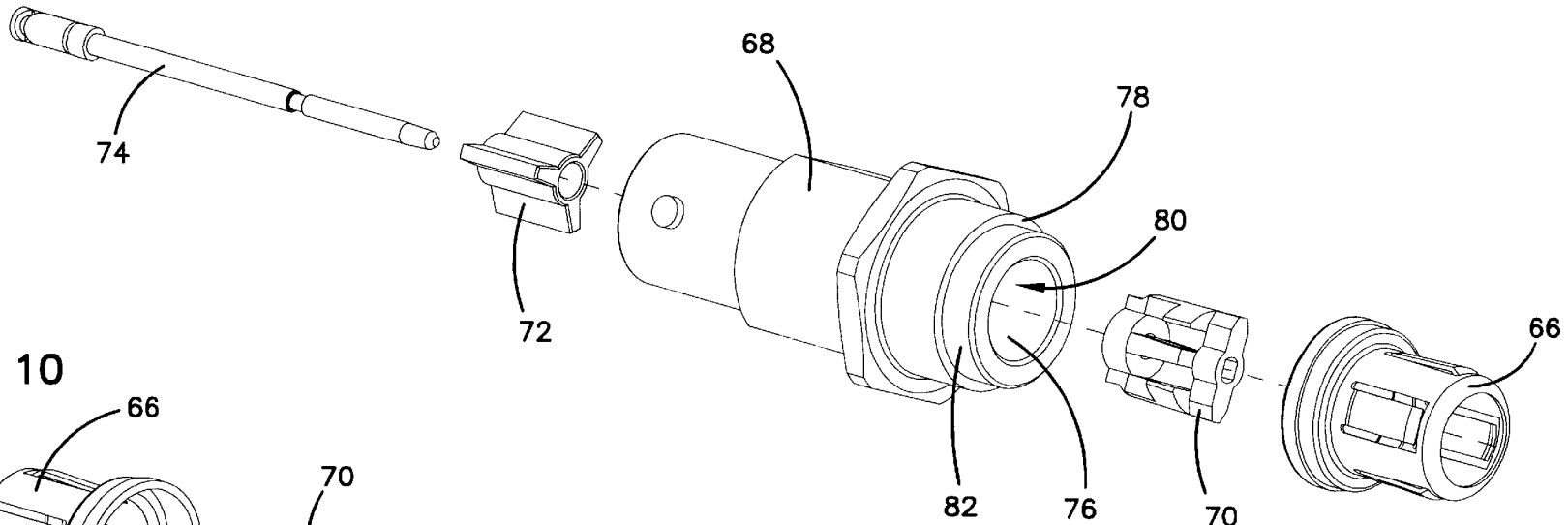
FIG. 9 is a first exploded view of the bulkhead mount coaxial connector of FIG. 8.
Figure 10:
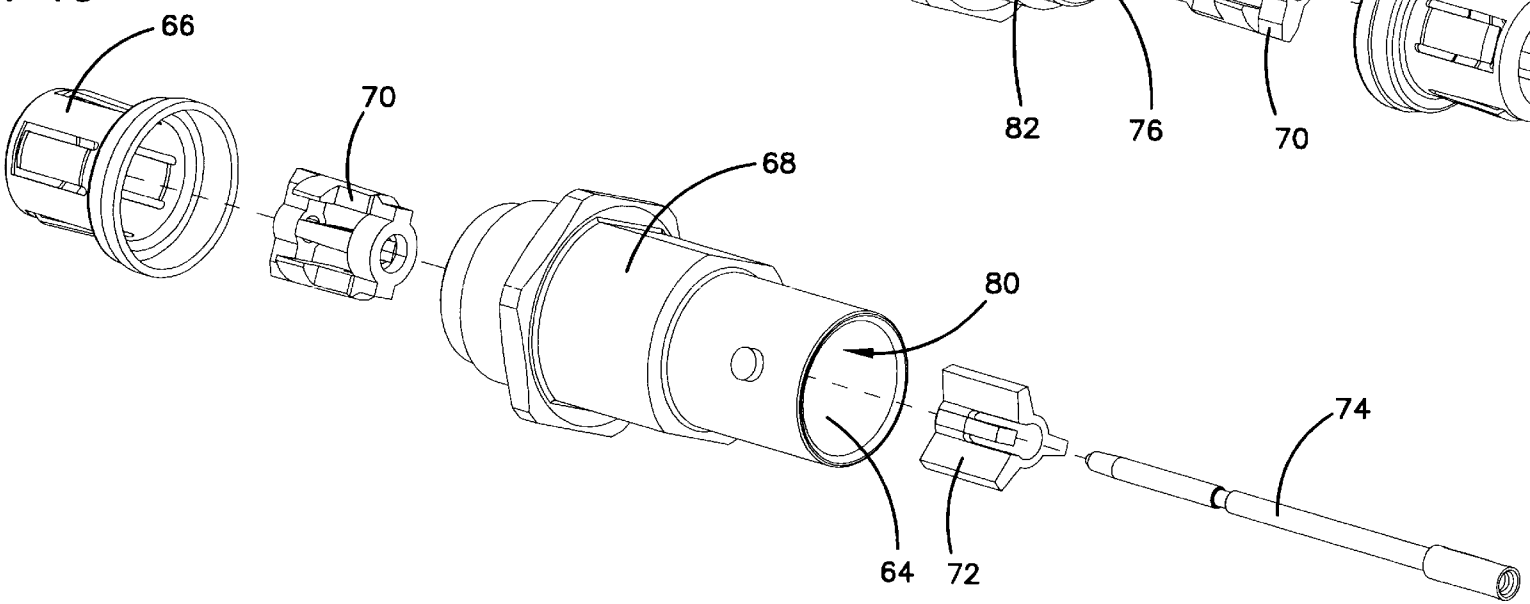
FIG. 10 is a second exploded view of the bulkhead mount coaxial connector of FIG. 8.
Figure 11:
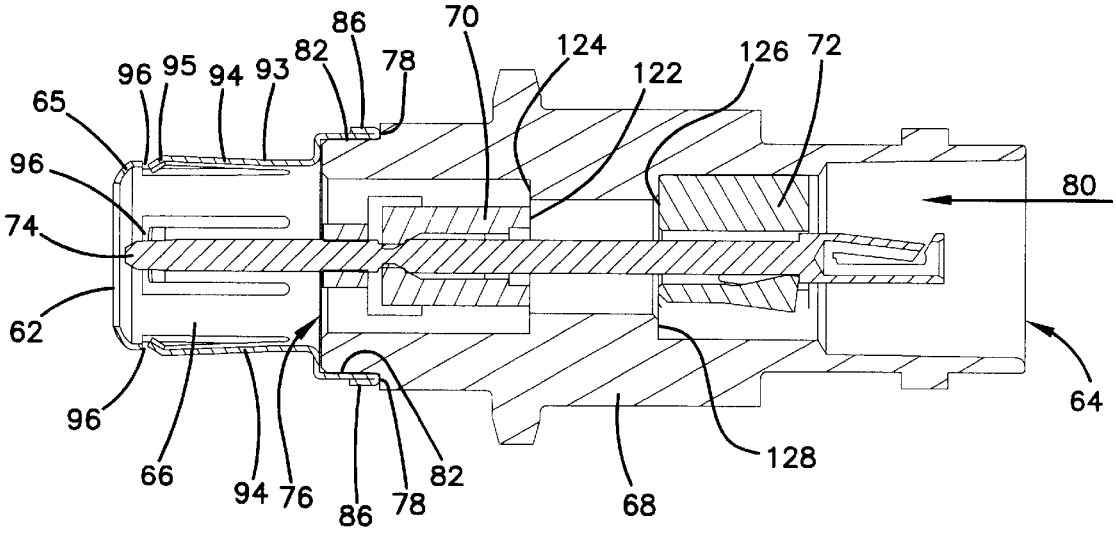
FIG. 11 is a cross-sectional view of the bulkhead mount coaxial connector of FIG. 8, taken along line 11—11.

FIG. 8 shows bulkhead connector 20 including a body 68, an end cap 66, a network interface end 64 and a module interface end 62. A pair of opposed, outwardly projecting bayonets 67 extend from body 68 proximate network interface end 64. Bayonets 67 cooperate with structure of a network coaxial cable (not shown) to securely connect the network cable to network interface end 64. FIGS. 9 and 10 show the internal parts comprising bulkhead connector 20, including a center conductor 74, a pair of insulators 72 and 70 into which center conductor 74 is inserted, and end cap 66. Center conductor 74, and insulators 70 and 72 are mounted within cavity 80 of body 68. Cavity 80 extends through the length of body 68, from network element interface opening 64 to opposing opening 76 proximate end cap 66. Defined proximate opposing end 76 are mounting ring 82 and ledge 78. FIG. 11 shows bulkhead connector 20 in cross-sectional view with center conductor 74, and insulators 70 and 72 inserted within cavity 80 and end cap 66 in place about mounting ring 82.

Figure 13:
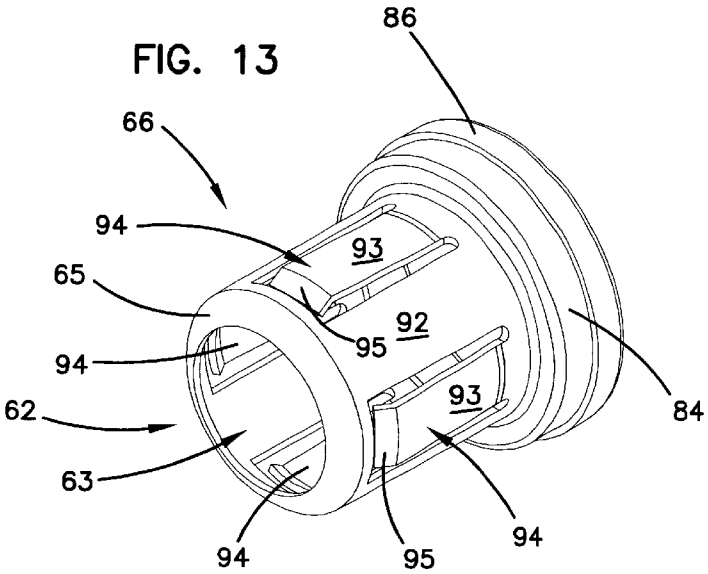
FIG. 13 is a second perspective view of the end cap of FIG. 12.
Figure 12:
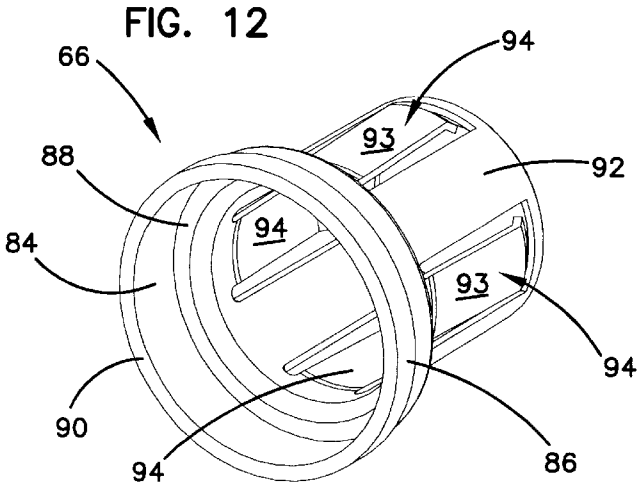
FIG. 12 is a first perspective view of an end cap according to the present invention for the bulkhead mount coaxial connector of FIG. 8.

Referring now to FIGS. 12 and 13, end cap 66 includes barrel 92, ring portion 84 with doubled edge 86 and shoulder 90, and ledge 88 connecting ring portion 84 and barrel 92. It is anticipated that end cap 66 will be made of a resilient, elastic metallic material such as phosphor bronze. Other similar materials of suitable elasticity and conductivity may also be used. In barrel 92 are four springs 94. Each spring 94 comprises an outward flared portion 93 and a ramped end 95. It is anticipated that the number of springs 94 can vary and may include only one. About module interface end 62 of end cap 66 is a closed end 65, which defines an opening 63. Closed end 65 is bevel shaped to facilitate mating with a coaxial connector 38 of a module 36 that might be slightly mis-aligned. Springs 94 as shown are attached to barrel 92 of end cap 66 proximate ledge 88 and extend toward closed end 65. Referring again to FIGS. 8 and 11, a gap 96 is defined between closed end 65 and ramped end 95 of each spring 94. The end of ramped end 95 adjacent gap 96 rests below the outer surface of closed end 65 so that ramped end 95 will not catch on coaxial connector 38 as coaxial connector 38 is mated with bulkhead connector 20. End cap 66 is suitable for manufacture by a deep drawing process although other methods of manufacture are anticipated as being suitable in keeping with principles of the present invention.

Referring now to FIG. 8, three outer diameters are defined by end cap 66. A first outer diameter A is defined by barrel 92. A second outer diameter C is defined by ring portion 84. And a third outer diameter B is defined by springs 94.

Figure 11A:
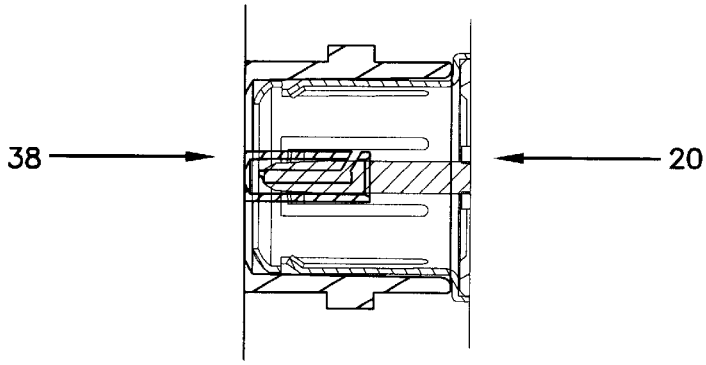
FIG. 11A is a cross-sectional view of a bulkhead mount coaxial connector of FIG. 11 mated with a module mount coaxial connector of the telecommunications circuit module of FIG. 7.

FIG. 11A is a cross-sectional view of a coaxial connector 38, such as shown mounted to a module 36, with a coaxial bulkhead connector 20 inserted.

Figure 21:
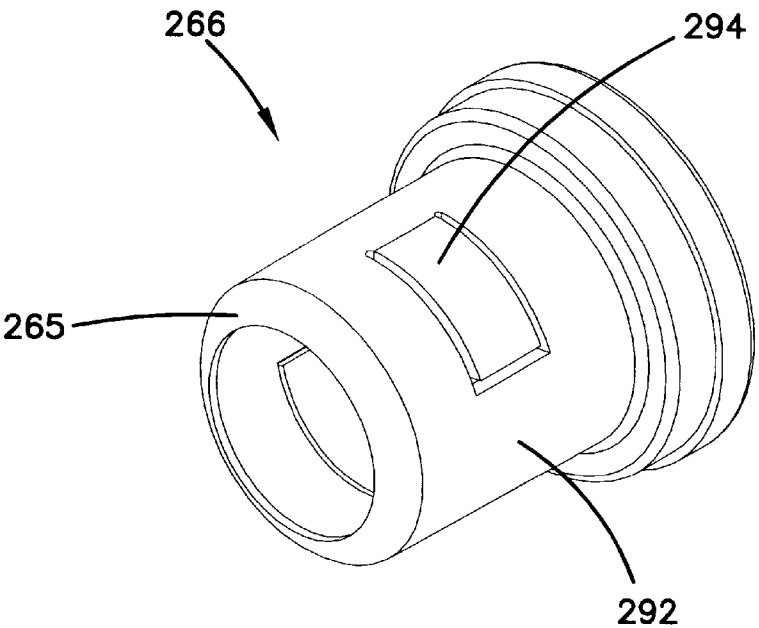
FIG. 21 is a perspective view of a second alternative end cap according to the present invention for the bulkhead mount coaxial connector of FIG. 8.
Figure 20:
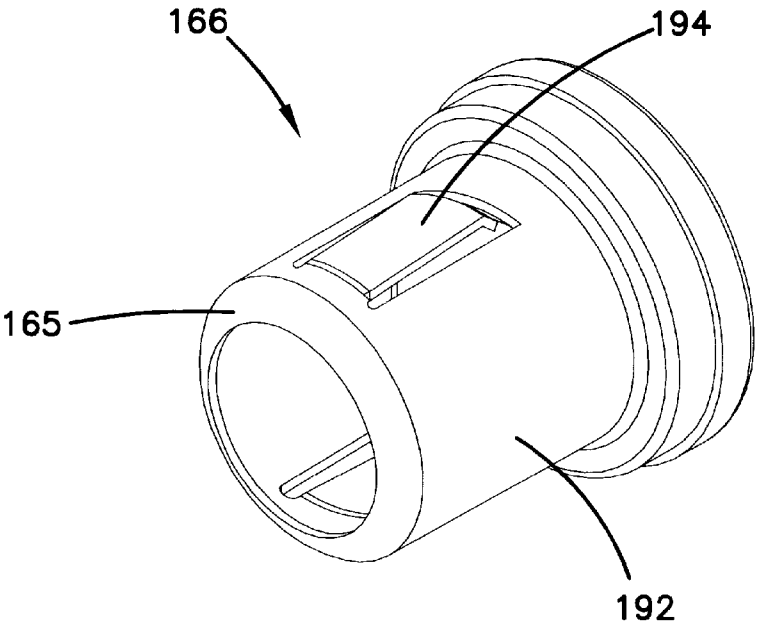
FIG. 20 is a perspective view of a first alternative end cap according to the present invention for the bulkhead mount coaxial connector of FIG. 8.

It is anticipated that springs 94 of end cap 66 could be configured as shown in FIGS. 20 and 21. In FIG. 20, an alternative end cap 166 is shown for use with a body 68. End cap 166 includes one or more springs 194 which extend along barrel 192. Springs 194 are attached to barrel 192 proximate closed end 165 and extend away from closed end 165. In FIG. 21, springs an alternative end cap 266 is shown for use with a body 68. End cap 266 includes one or more springs 294 which extend along barrel 292. Springs 294 are attached to barrel 292 and extends parallel to closed end 265. Aside from the differences in the direction and orientation of the springs, end caps 166 and 266 are otherwise identical to end cap 66.

It is anticipated that end cap 66 may be formed by a variety of known metal forming methods, such as deep drawing. The process of drawing end cap 66 begins with a flat piece of an appropriately conductive metal, such as phosphor bronze. This flat piece of material is formed into a cylindrical shape or barrel having a closed end, an open end and a flange about the open end. An opening is formed in the closed end of the barrel, the opening being smaller in diameter than the barrel. About the barrel between the open end and the closed end are formed one or more resilient springs which extend beyond the diameter of the barrel. The flange about the open end of the barrel is formed to enable the cap to be mounted to an electrical connector body such as body 68 as part of the assembly of bulkhead connector 20.

Figure 15:
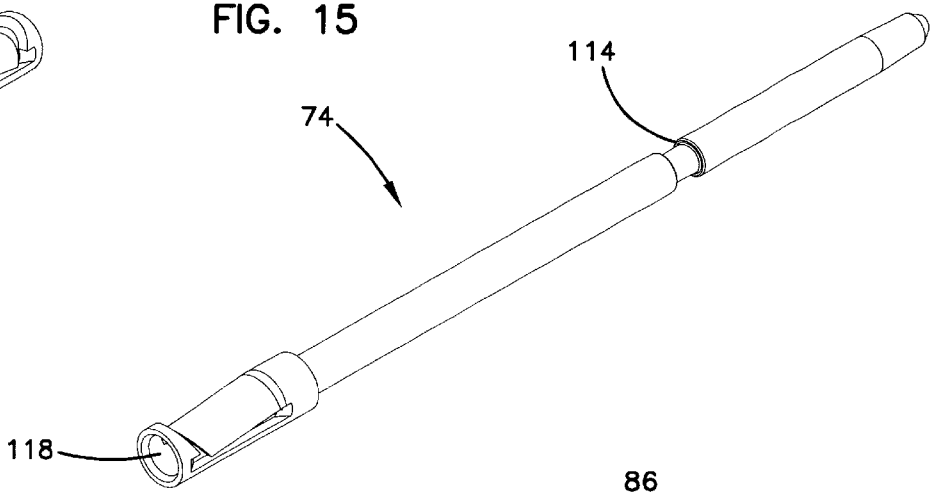
FIG. 15 is a second perspective view of the center conductor of FIG. 14.
Figure 14:
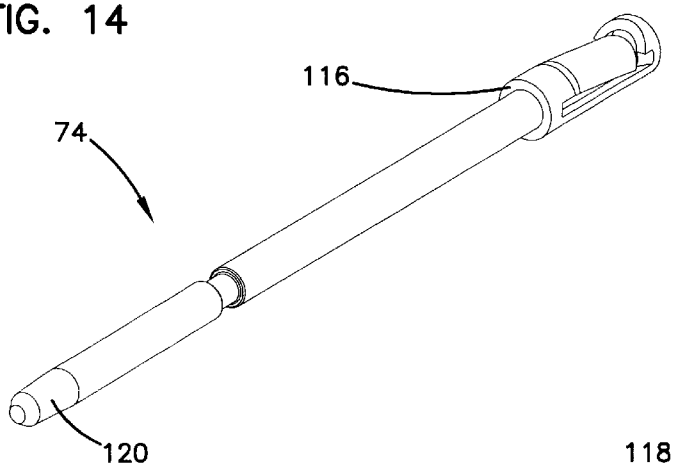
FIG. 14 is a first perspective view of a center conductor for the bulkhead mount coaxial connector of FIG. 8.
Figure 16:
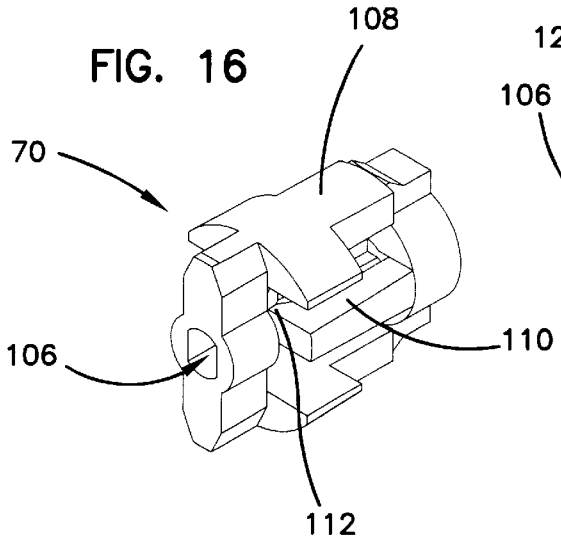
FIG. 16 is a first perspective view of a first center conductor insulator for the bulkhead mount coaxial connector of FIG. 8.
Figure 17:
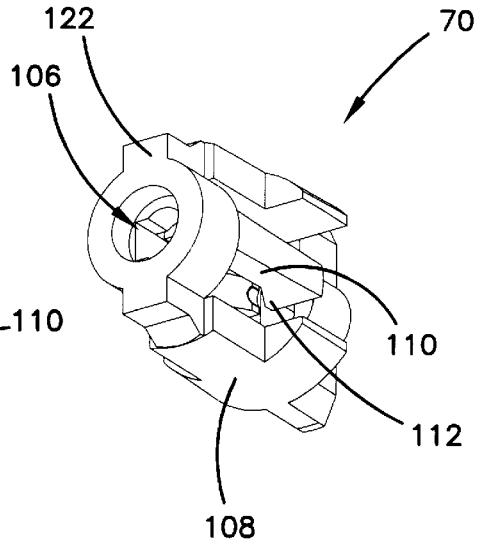
FIG. 17 is a second perspective view of the first center conductor insulator of FIG. 16.
Figure 18:
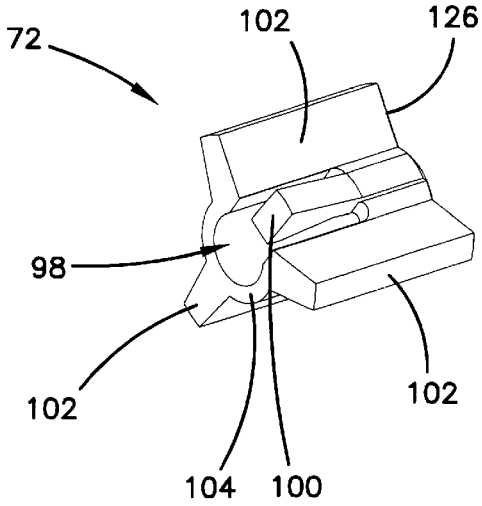
FIG. 18 is a first perspective view of a second center conductor insulator for the bulkhead mount coaxial connector of FIG. 8.
Figure 19:
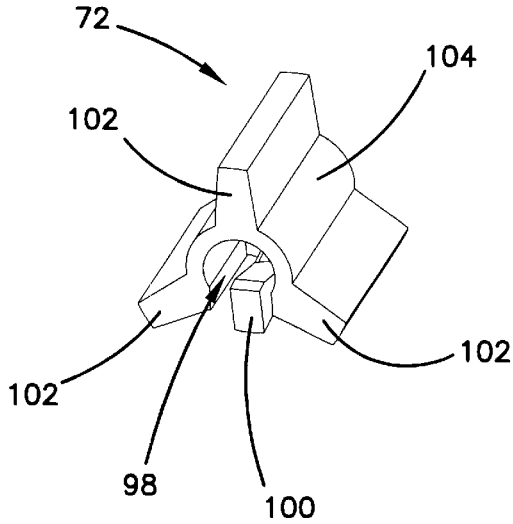
FIG. 19 is a second perspective view of the second center conductor insulator of FIG. 18.

Referring now to FIGS. 14 and 15, center conductor 74 includes a connector end 120, a mating end 118, a first mounting ledge 114 and a second mounting ledge 116, adjacent mating end 118. Mating end 118 as shown is suitable for engaging the center conductor of a BNC coaxial connector. It is anticipated that bulkhead connector 20 will be adapted for use with other types of coaxial connectors and that mating end 118 will be altered as necessary to mate with the center conductor of these connectors. Referring now to FIGS. 16 and 17, insulator 70 includes a central opening 106, outer bearing surfaces 108, and arms 110 with locking tabs 112. Referring now to FIGS. 18 and 19, insulator 72 includes a central opening 98, tab 100, and equal sized wings 102 extending from body 104. It is anticipated that a variety of alternative designs for insulators are possible, provided they perform the required functions of holding center conductor 74 within cavity 80 and electrically insulating center conductor 74 from body 68.

When assembled as shown in FIG. 11, center conductor 74 extends through central opening 98 of insulator 72 with tab 100 resting against second mounting ledge 116. Wings 102 extend to contact body 68 and hold mating end 118 centered within cavity 80. Center conductor 74 also extends through central opening 106 of insulator 70 with locking tabs 112 engaging first mounting ledge 114. End cap 66 is fit about mounting ring 82 with shoulder 90 resting against ledge 78. As shown, end cap 66 and body 68 are appropriate for the use of swaging or press fitting to fixedly hold end cap 66 to body 68. It is anticipated that other forms of mechanical joining of end cap 66 and body 68 may be used without altering end cap 66 and body 68 beyond the principles of the present invention. Connector end 120 of center conductor 74 extends through opposing opening 76 and into barrel 92 of end cap 66. Bearing surfaces 108 of insulator 70 rest against body 68 to hold connector end 120 centered barrel 92. Insulator 70 includes a inner surface 122 that rests against a first inner surface 122 within body 68 and insulator 72 includes a inner surface 126 that rests against a second inner surface 128 within body 68 when insulators 70 and 72 engage center conductor 74. The combination of insulators 70 and 72 engaging center conductor 74 and inner surfaces 124 and 128 holds center conductor 74 within body 68.

Having described preferred aspects and embodiments of the present invention, modifications and equivalents of the disclosed concepts may readily occur to one skilled in the art. However, it is intended that such modifications and equivalents be included within the scope of the claims which are hereto appended.

What is claimed is as follows:

1. A telecommunications coaxial connector comprising:

a body defining a longitudinal axis, the body including a first open end, an opposite second open end and an axial opening defined through the body between the first open end and the second open end;

a cap positioned about the first open end, the cap electrically connected with the body;

the cap including a side wall, an open end opposite the first open end of the body aligned with the axial opening, a continuous ring about the open end of the cap and an integral spring member defined in the side wall, the spring member moveable radially inwardly toward the longitudinal axis;

a center conductor with a first end and second end, the center conductor positioned within the axial opening such that the first end of the center conductor extends beyond the first open end of the body into the cap; and an insulator electrically isolating the center conductor from the body.

2. The telecommunications coaxial connector of claim 1, wherein the body is made of cast zinc.

3. The telecommunications coaxial connector of claim 1, wherein the cap is made of phosphor bronze.

4. The telecommunications coaxial connector of claim 1, wherein the insulator includes a first insulator portion proximate the first open end of the body and a second insulator portion proximate the second open end of the body, the first and second insulator portions cooperating to hold the center conductor centered within the axial opening and electrically insulate the center conductor from the body.

5. The telecommunications coaxial connector of claim 1, wherein the integral spring member is a first integral spring member and further comprising a second integral spring member defined in the side wall of the cap.

6. The telecommunications coaxial connector of claim 1, wherein the integral spring member is a first integral spring member and further comprising a second integral spring member and a third integral spring member defined in the side wall of the cap.

7. The telecommunications coaxial connector of claim 1, wherein the integral spring member is a first integral spring member and further comprising a second integral spring member, a third integral spring member and a fourth integral spring member defined in the side wall of the cap.

8. The telecommunications coaxial connector of claim 1, wherein the second open end of the body and the first open end of the cap are each adapted to receive and electrically connect with a BNC coaxial connector, wherein the second open end of the body includes outwardly radially projecting bayonets and adapted to mate within a male BNC coaxial cable connector and the first open end of the cap adapted to mate within a female BNC coaxial connector.

9. The telecommunications coaxial connector of claim 1, wherein the spring member extends parallel to the longitudinal axis of the body and is attached to the sidewall of the cap proximate the first open end of the cap.

10. The telecommunications coaxial connector of claim 1, wherein the spring member extends parallel to the longitudinal axis of the body and is attached to the sidewall of the cap proximate the first open end of the body.

11. The telecommunications coaxial connector of claim 1, wherein the spring member extends along the sidewall of the cap transverse to the longitudinal axis of the body.

12. A telecommunications chassis comprising:

a first bulkhead with pairs of coaxial telecommunications connectors, each coaxial telecommunications connector having a first end and a second end electrically connected to the first end;

opposing side walls, a top wall and a bottom forming an enclosure with a first open end and a second open end, the bulkhead positioned across a portion of the second open end with the first end of the coaxial telecommunications connectors within the enclosure;

the coaxial telecommunications connectors including:

a body defining a longitudinal axis, the body including a first open end, an opposite second open end and an axial opening defined through the body between the first open end and the second open end;

a cap positioned about the first open end, the cap electrically connected with the body;

the cap including a side wall, an open end opposite the first open end of the body aligned with the axial opening, a continuous ring about the open end of the cap and an integral spring member defined in the side wall, the spring member moveable radially inwardly toward the longitudinal axis;

a center conductor with a first end and second end, the center conductor positioned within the axial opening such that the first end of the center conductor extends beyond the first open end of the body into the cap; and an insulator electrically isolating the center conductor from the body.

13. The telecommunications chassis of claim 12, wherein the enclosure is configured to receive a module including a telecommunications circuit, the module having a first end and a second end, the first end including coaxial telecommunications connectors, the coaxial telecommunications connectors of the bulkhead being positioned to fit within the coaxial telecommunications connectors on the first end of the module when the module is positioned within the enclosure.

* * * * *